US008257118B2

(12) United States Patent
Bareel et al.

(10) Patent No.: US 8,257,118 B2
(45) Date of Patent: Sep. 4, 2012

(54) COMMUNICATION ASSEMBLY COMPRISING A PLUG CONNECTOR AND A JACK ASSEMBLY PROVIDED TO BE CONNECTED

(75) Inventors: Baudouin Bareel, Auderghem (BE); Peter D'Hondt, Lebbeke (BE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 13/116,183

(22) Filed: May 26, 2011

(65) Prior Publication Data

US 2012/0003877 A1 Jan. 5, 2012

(30) Foreign Application Priority Data

Feb. 7, 2010 (EP) ..... 10305727

(51) Int. Cl.
*H01R 13/625* (2006.01)

(52) U.S. Cl. ..... 439/676

(58) Field of Classification Search ..... 439/676, 439/76.1, 344, 189, 395
See application file for complete search history.

(56) References Cited

U.S. PATENT DOCUMENTS 6,464,541 B1 10/2002 Hashim et al.
6,530,810 B2 * 3/2003 Goodrich et al. ..... 439/676
6,579,128 B1 * 6/2003 Wu ..... 439/676
6,641,443 B1 * 11/2003 Itano et al. ..... 439/676
6,786,776 B2 * 9/2004 Itano et al. ..... 439/676
7,601,034 B1 * 10/2009 Aekins et al. ..... 439/676
7,682,203 B1 * 3/2010 Pharney et al. ..... 439/676

* cited by examiner

*Primary Examiner* — Tulsidas C Patel
*Assistant Examiner* — Phuongchi Nguyen
(74) *Attorney, Agent, or Firm* — Sofer & Haroun, LLP

(57) ABSTRACT

A communication assembly has a plug connector (1) and a jack assembly (2) provided to be connected. The jack assembly has a first printed wiring board (4) having associated crosstalk compensation elements with corresponding contact elements (6), a second printed wiring board (5) and at least a first and a second pair of contact wires (3), where each of the contact wires (3) has a base (3B) supported on the second board and a opposite free end (3A). The free ends (3A) of contact wires of second printed wiring board (5) establish an electrical connection with a corresponding terminal pad of the plug connector (1) and the contact elements (6) of the first printed wiring board (22) are aligned beneath corresponding free ends (3A) of the contact wires of the second printed wiring board so that the free ends (3A) establish electrical contact with the contact elements (6) of the first printed wiring board when they are engaged by the plug connector (1). The electrical contact is at a distance smaller than 5 mm from the physical location of the electrical connection with corresponding terminal pads of the plug connector.

3 Claims, 3 Drawing Sheets

COMMUNICATION ASSEMBLY COMPRISING A PLUG CONNECTOR AND A JACK ASSEMBLY PROVIDED TO BE CONNECTED

RELATED APPLICATIONS

This application claims the benefit of priority from European Patent Application No. 10 305 727.9, filed on Jul. 2, 2010, the entirety of which is incorporated by reference.

BACKGROUND

1. Field of the Invention

The invention concerns a communication assembly comprising a plug connector and a jack assembly provided to be connected.

2. Description of Related Art

Communication connectors that are configured to suppress or to compensate for crosstalk that originates from within a connector, are generally known. Crosstalk arises when signals conducted over a first path, e.g. a pair of contact wires in a communication plug connector, are partly coupled electromagnetically into a second signal path (e.g. another pair of contact wires) within the same connector. The signals coupled from the first path may be detected as "crosstalk" in the second path, and such crosstalk degrades existing signals that are being routed over the second path.

Crosstalk compensation circuitry may be provided on layers of a printed wire board to which the contact wires of a communication jack are connected.

The patent document U.S. Pat. No. 6,464,541 describes a communication jack assembly, comprising a first printed wiring board having associated capacitance elements with corresponding capacitance contact pads, a second printed wiring board and at least a first and a second pair of contact wires.

Each of the contact wires has a base supported on the second board, a free end, and an intermediate portion extending between the base and the free end, and the intermediate portion has an ice for establishing an electrical connection with a corresponding terminal of a mating plug connector.

The capacitance contact pads on the first printed wiring board are aligned beneath corresponding free ends of the contact wires so that the free ends establish electrical contact with the pads when the contact wires are engaged by the plug connector. The capacitance elements of the first board form part of a first crosstalk compensation stage for providing a first level of capacitive compensation coupling corresponding in magnitude to a sum of offending capacitive crosstalk and offending inductive crosstalk to be introduced to the jack assembly by the mating plug connector.

The second board has capacitance and inductance elements for forming part of a second crosstalk compensation stage for providing both (a) a level of inductive compensation coupling, though trace layout of conductive traces on said second board which communicate with at least one of said first and second pairs of contact wires, that corresponds in magnitude to the offending inductive crosstalk generated from the plug connector, and (b) a second level of capacitive coupling that corresponds in magnitude and has a polarity opposite to that of the level of inductive compensation coupling.

Near end crosstalk (NEXT) and far end crosstalk (FEXT) that would otherwise be produced when the jack assembly is engaged by the mating plug connector, are compensated by the compensation crosstalk provided by the first and the second crosstalk compensation stages in the jack assembly.

OBJECTS AND SUMMARY

Such communication jack assembly comprises two compensation stages and the second compensation in fact is effective for only one given frequency but is not effective for a whole range of frequencies. On such range a peak appears for at least one given frequency. It is difficult to adjust the amplitude of first and second compensation but also the phase shift between offending signal, first compensation level and second compensation level to minimize the NEXT at the optimal frequency.

The object of the invention is to obtain an effective compensation for very high frequencies, going towards 500 MHz, without necessity of a second stage of compensation.

In this goal, the invention proposes a communication assembly comprising a plug connector and a jack assembly provided to be connected, said jack assembly comprising, a first printed wiring board having associated crosstalk compensation elements with corresponding contact elements, a second printed wiring board and at least a first and a second pair of contact wires, wherein each of the contact wires has a base supported on the second board and a opposite free end, said contact elements of said first printed wiring board being aligned beneath corresponding free ends of the contact wires of said second printed wiring board, so that the free ends are in electrical contact with the contact elements of said first printed wiring board when they are engaged by the plug connector, characterized in that said free ends of contact wires of second printed wiring board establish an electrical connection with a corresponding terminal pad of said plug connector and that said contact elements of said first printed wiring board are aligned flexible contact wires, so that the free ends establish by their deformation electrical contact with the contact elements of said first printed wiring board when they are engaged by the plug connector, said electrical contact being at a distance smaller than 5 mm from the physical location of said electrical connection with corresponding terminal pads of the plug connector.

Preferably, said electrical contact is at the physical location of the said electrical connection with corresponding terminal pads of the plug connector.

Preferably, the pads of the plug connector, the contact wires of the second printed wiring board and the contact wires of the first printed wiring board have their contact surfaces superposed in this order, when the jack assembly is introduced by the plug connector.

BRIEF DESCRIPTION OF THE DRAWINGS

For a better understanding of the invention, reference is made to the following description taken in conjunction with the accompanying drawing.

DETAILED DESCRIPTION

Figure 1:
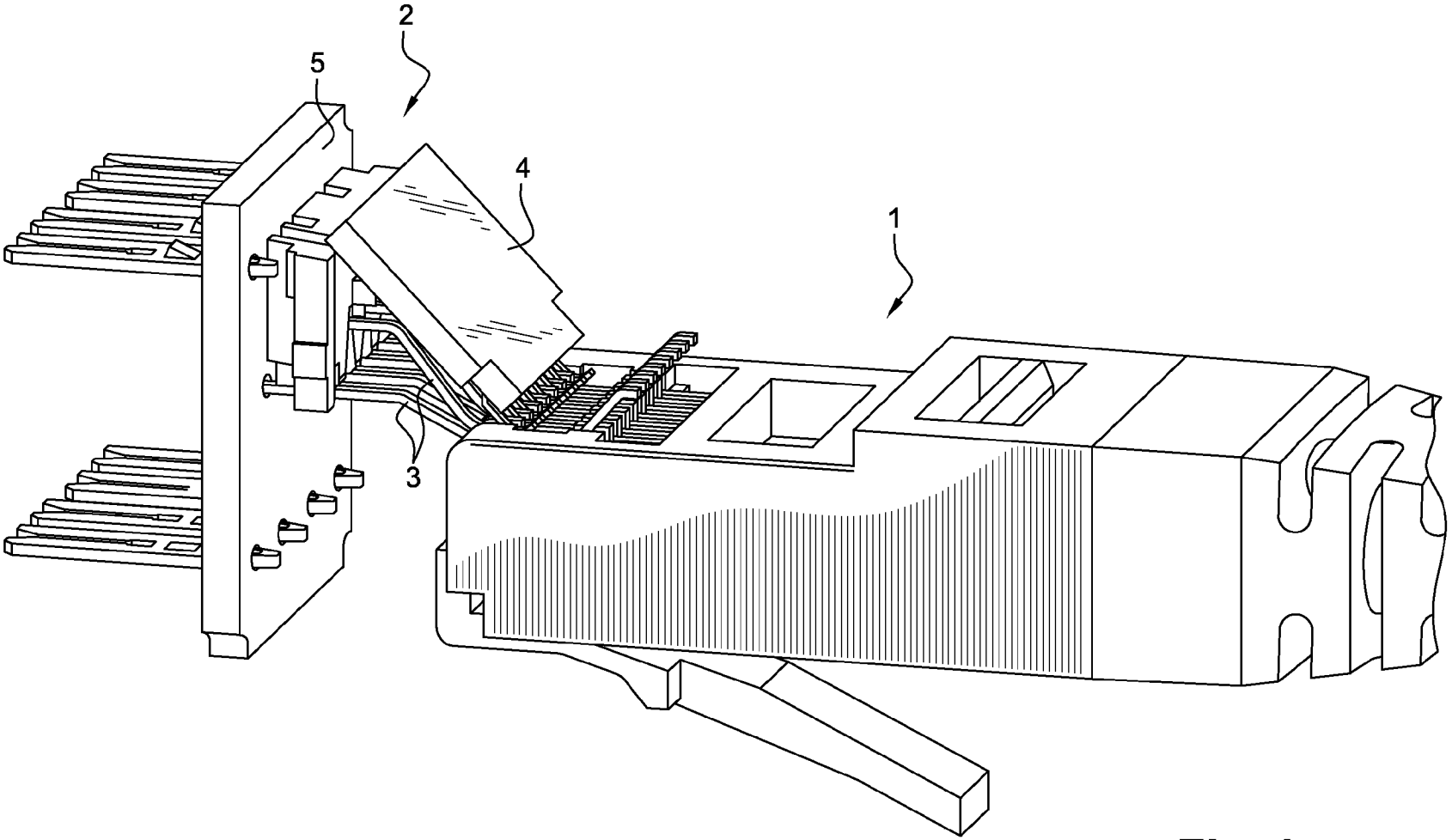
FIG. 1 is a perspective view of a communication assembly according to the invention, when plug connector and jack assembly are connected.
Figure 2:
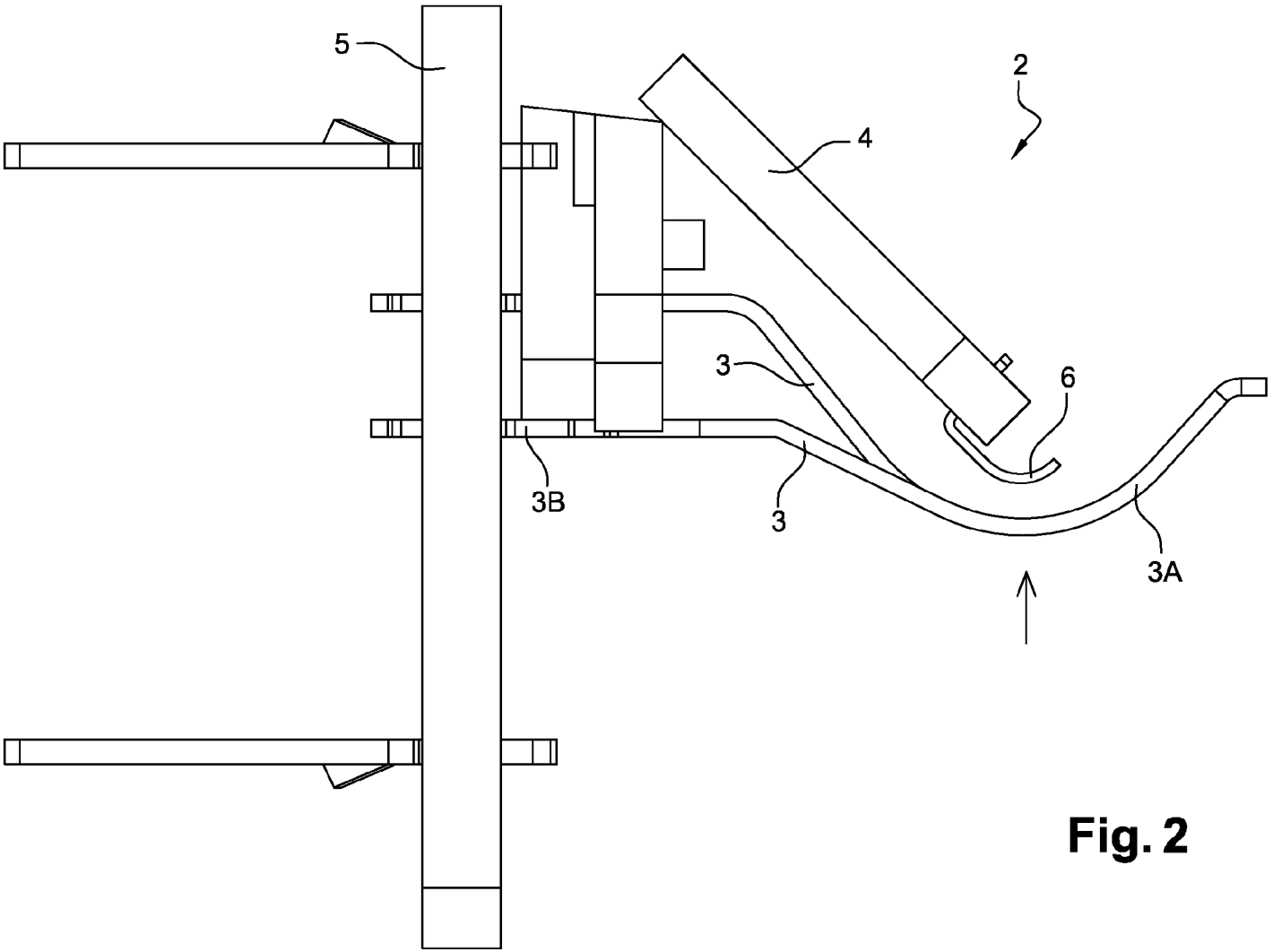
FIG. 2 is a partial side view of a portion of the connector according to the invention, representing a jack assembly without plug connector connected.

As represented in FIGS. 1 and 2, a communication assembly comprises a plug connector 1 and a jack assembly 2, comprising several pairs of contact wires 3, a first printed wiring board 4 and a second printed wiring board 5. Outer connector housing and associated structure of the jack assembly are omitted in the figure for purposes of clarity.

The first printed wiring board 4 has an array of contact elements 6, constituted by flexible contacts wires, in proximity to a front edge of the board. The contact wires 6 are aligned beneath corresponding free ends 3A of the contact wires 3 of the second printed wiring board 5. When terminals or pads of a plug connector (not shown in FIG. 2) engage the contact wires 3 of the second printed wiring board 4, the contact wires 3 of the second printed wiring board 5 deflect resiliently upward and their free ends 3A establish electrical contact with the corresponding contact wires 6 of the first printed wiring board 4. Certain values of capacitance and/or inductance are provided on the first board 4, between selected pairs of their contact wires 6 in order to implement a stage of compensation coupling in the jack assembly 2. The capacitance and/or inductance elements of the first board form crosstalk compensation stage for providing a capacitive and/or inductive compensation coupling corresponding in magnitude to a sum of offending capacitive crosstalk and offending inductive crosstalk to be introduced to the jack assembly by the plug connector.

Figure 3:
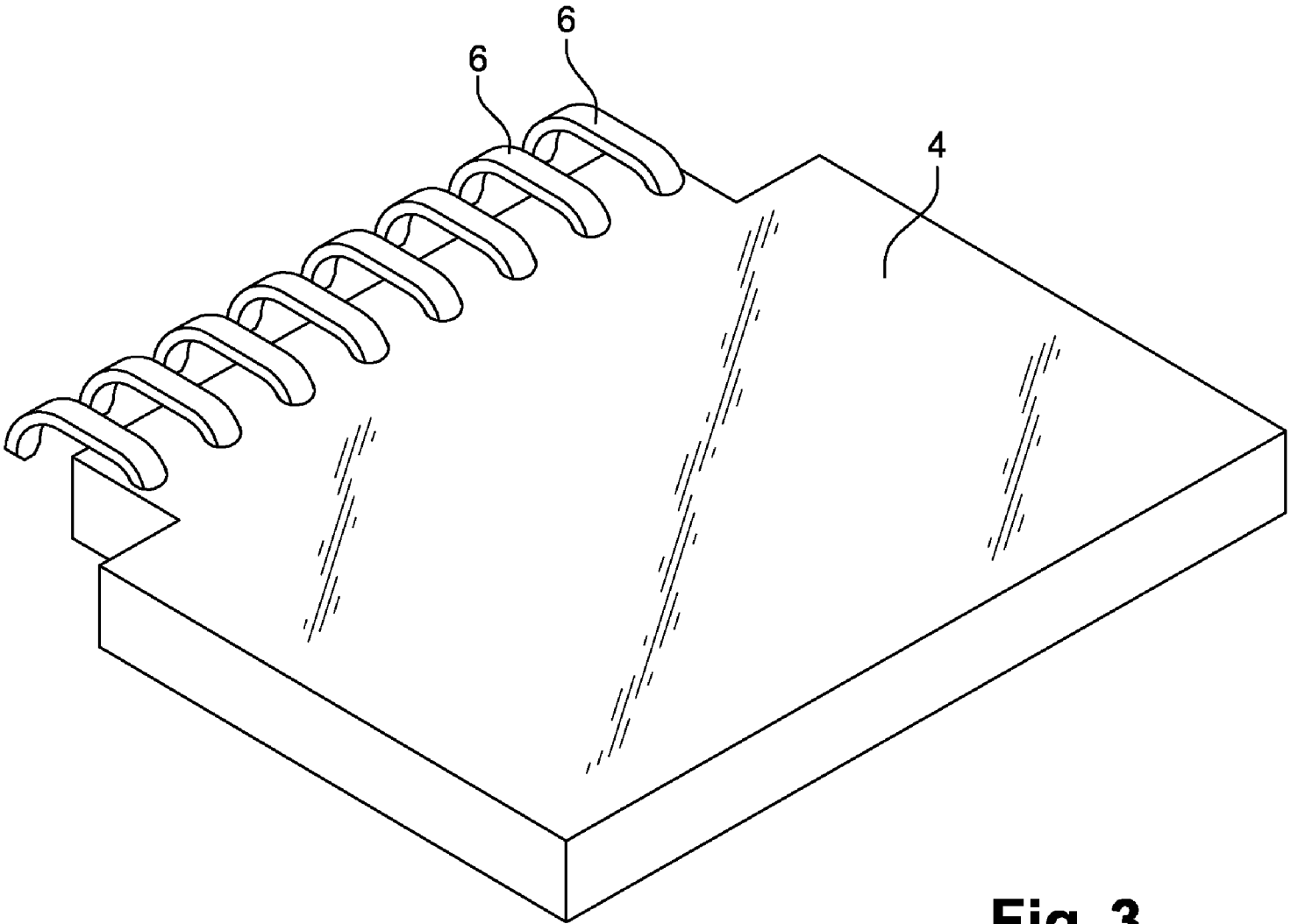
FIG. 3 is a partial perspective view of a jack assembly according to the invention.

Usually, the section of the contact wires 3 of the second printed wiring board 4 is around 0.25 mm to have enough pressure of the jack terminals or pads on these plug contacts in order to have a contact resistance conform to the standard. The contact elements 6 of the first printed board 4 have preferably a section of less than 0.1 mm to be more flexible and to be as short as possible The contact wires 6 are supported above the contact wires 3 of the second printed wiring board 5 by the first printed wiring board 4. Bases of the contact wires are press-fit or otherwise fixed in corresponding terminal openings formed in the corresponding wiring board. The FIG. 3 shows the first printed wiring board 4 with its contact wires 6 assembled by such manner.

The second wiring board 5 includes circuitry for connection but does not include stage of compensation coupling.

The contact wires 6 of the first printed wiring board 4 are aligned beneath corresponding free ends 3A of the contact wires of the second printed wiring board 5 so that the free ends 3A of the contact wires of the second printed wiring board 5 establish electrical contact with the contact wires 6 of the first printed wiring board 4 when they are engaged by the plug connector and are coming in an electrical connection with corresponding terminal pads of the plug connector, this plug connector acting according to the vertical arrow of the FIG. 2.

When the plug connector and jack assembly are connected, as represented in the FIG. 1, the pads of the plug connector, the contact wires 3 of the second printed wiring board 5 and the contact wires 6 of the first printed wiring board 4 have their contact surfaces superposed in this order. These contacts elements are aligned in a vertical plane (according to the drawings) in this order. By means of this arrangement, these contacts elements come in electrical contacts in the same physical location. Crosstalk is minimised because no crosstalk is developed among bases 3B and free ends 3A of the contact wires of the second printed wiring board 5 between the plug/jack contact line and the second wiring board 5.

The preceding specification concerns a preferred embodiment of the invention, but, according to the invention, the electrical contact of the free ends 3A with the contact elements 6 of the first printed wiring board can be at a distance smaller that 5 mm from the physical location of electrical contact of the free ends 3A with corresponding terminal pads of the plug connector. Such distance of 5 mm gives a phase shift of 4.5° at 500 MHz, and since NEXT is crosstalk energy travelling in the opposite direction, the overall phase shift will be 9°. A distance smaller than 5 mm will give an overall shift less than 9° giving a NEXT improvement until 500 MHz, corresponding to the cat6a maximum frequency. In such case, no significant crosstalk is developed among bases and free ends of the contact wires 3 of the second printed wiring board 5 between the plug/jack contact line and the second wiring board 5.

The invention claimed is:

1. Communication assembly comprising:

a plug connector; and a jack assembly provided to be connected, said jack assembly comprising:

a first printed wiring board having associated crosstalk compensation elements with corresponding contact elements;

a second printed wiring board; and at least a first and a second pair of contact wires, wherein each of the contact wires has a base supported on the second board and an opposite free end, said contact elements of said first printed wiring board being aligned beneath corresponding free ends of the contact wires of said second printed wiring board, so that the free ends are in electrical contact with the contact elements of said first printed wiring board when they are engaged by the plug connector, wherein said free ends of contact wires of second printed wiring board establish an electrical connection with a corresponding terminal pad of said plug connector and that said contact elements of said first printed wiring board are aligned flexible contact wires, so that the free ends establish by theft deformation electrical contact with the contact elements of said first printed wiring board when they are engaged by the plug connector, said electrical contact being at a distance smaller than 5 mm from the physical location of said electrical connection with corresponding terminal pads of the plug connector.

2. Communication assembly according to claim 1, wherein said electrical contact is at the physical location of the said electrical connection with corresponding terminal pads of the plug connector.

3. Communication assembly according to claim 2, wherein the pads of the plug connector, the contact wires of the second printed wiring board and the contact wires of the first printed wiring board have their contact surfaces superposed in this order, when the jack assembly is introduced by the plug connector.

* * * * *